US008104102B2

(12) United States Patent
O'Hanley

(10) Patent No.: US 8,104,102 B2
(45) Date of Patent: Jan. 31, 2012

(54) METHOD AND APPARATUS FOR UNCLOGGING A TOILET

(76) Inventor: Alex H. O'Hanley, Bristol, RI (US)

( * ) Notice: Subject to any disclaimer, the term of this patent is extended or adjusted under 35 U.S.C. 154(b) by 1362 days.

(21) Appl. No.: 11/714,608

(22) Filed: Mar. 5, 2007

(65) Prior Publication Data

US 2007/0209100 A1 Sep. 13, 2007

Related U.S. Application Data

(60) Provisional application No. 60/780,769, filed on Mar. 9, 2006.

(51) Int. Cl.
*E03D 9/00* (2006.01)
*E03D 11/00* (2006.01)

(52) U.S. Cl. ..... 4/255.01; 4/255.11

(58) Field of Classification Search ..... 4/255.01, 4/255.05, 255.11
See application file for complete search history.

(56) References Cited

U.S. PATENT DOCUMENTS

| | | | |
|---|---|---|---|
| 271,357 | A | 1/1883 | Pike |
| 679,007 | A | 7/1901 | Senff |
| 716,090 | A | 12/1902 | Nyberg |
| 2,529,587 | A | 11/1950 | Bates et al. |
| 2,844,826 | A | 7/1958 | Cheiten |
| 3,346,888 | A | 10/1967 | Paysinger |
| 4,539,985 | A | 9/1985 | Magrath |
| 4,745,641 | A | 5/1988 | Tash |
| 5,600,856 | A | 2/1997 | Kang |
| 5,768,719 | A | 6/1998 | Harvey |
| 5,852,834 | A | 12/1998 | Harvey |
| 5,963,994 | A | 10/1999 | Harvey |
| 6,067,668 | A | 5/2000 | Rudd |
| 6,643,854 | B1 | 11/2003 | Jensen |
| 6,804,838 | B2 | 10/2004 | Lacus |
| 2004/0154086 | A1 | 8/2004 | Lacus |
| 2006/0225192 | A1 | 10/2006 | Williams |

*Primary Examiner* — Darren W Gorman
(74) *Attorney, Agent, or Firm* — Peter W. Murphy

(57) ABSTRACT

A toilet unclogging device rests on top of a toilet bowl rim and a user actuating a diaphragm or expandable central portion generates a temporary vacuum that repositions or reshapes an obstruction located below a water line to unclog the toilet without submerging any items beneath the water line of the toilet bowl.

9 Claims, 6 Drawing Sheets

METHOD AND APPARATUS FOR UNCLOGGING A TOILET

CROSS-REFERENCE TO RELATED APPLICATIONS

This application claims the benefit of U.S. provisional patent application Ser. No. 60/780,769 Mar. 9, 2006, entitled Top Dry Plunger. The entire disclosure of which is incorporated herein by reference in its entirety.

BACKGROUND OF THE INVENTION

FIG. 1 is a section view of a toilet 100. The toilet may have a seat 142 and a lid 140. The toilet 100 has a tank 104 in fluid and air communication with a bowl 106 through a series of jets 108. The tank 104 holds a volume of water in an inner tank area 110. A flush handle 112 is coupled to a flush valve 114 with a chain or rope. When the flush handle 112 is actuated by a user, the chain or rope causes the flush valve 114 to open and the water in the inner tank area 110 flows towards and then through the jets 108 and into an inner toilet bowl area 116. Water and waste in the inner toilet bowl area 116 then flows through a siphon 118 near the base of the toilet bowl 106 which is in fluid communication with a sewer pipe 120. The flush valve 114 eventually closes and the tank 104 starts filling back up with water for the next flush. A filler valve 128 allows water to flow through an overflow tube 102 and into the bowl 106 through the jets 108. A filler float 126 closes off the filler valve 128 when water in the inner tank area 110 reaches a predetermined height and the toilet is ready to be flushed again.

Toilet paper, paper towels, or other items dropped in the toilet bowl may become lodged in the siphon 118 and prevent the water and waste from exiting the inner toilet bowl area 116 which in turn can cause the water level in the inner toilet bowl area 116 to rise above a normal level 122. If the water rises too high (above a toilet bowl rim 124), the toilet waste and water can spill on to the adjacent floor and cause damage.

Plungers have been used for many years to help unclog a clogged toilet. These plungers typically have a rubber membrane in a hemispherical shape connected to a pole. The rubber membrane is submerged in a toilet bowl and the user pushes the pole downward numerous times in an attempt to push the clog towards the sewer line. Pushing the obstruction towards the sewer line often simply wedges the obstruction in place. The membrane returns to its original shape when pressure against the rim of the plunger is removed and the user can push again. Another drawback to this system is that the rubber membrane and a portion of the pole come into contact with the waste that would not flush which presents sanitation issues and limits where the plunger can be stored.

Other unclogging devices have been placed on top of and secured to the toilet bowl rim with an adhesive. The user attempts to dislodge the clog by pushing a membrane downward (towards the water line in the toilet bowl area). This pushing motion attempts to move the clog by increasing the pressure in the area above the water line in the inner toilet bowl area. The problem with this type of system is that this increase in pressure often causes the flush valve to reopen which then adds more water to a toilet bowl area with an already elevated water line. Some of theses unclogging devices require the user to remove the tank cover and place a stopper over the top of the overflow tube to decrease the pressure loss.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

Figure 1:
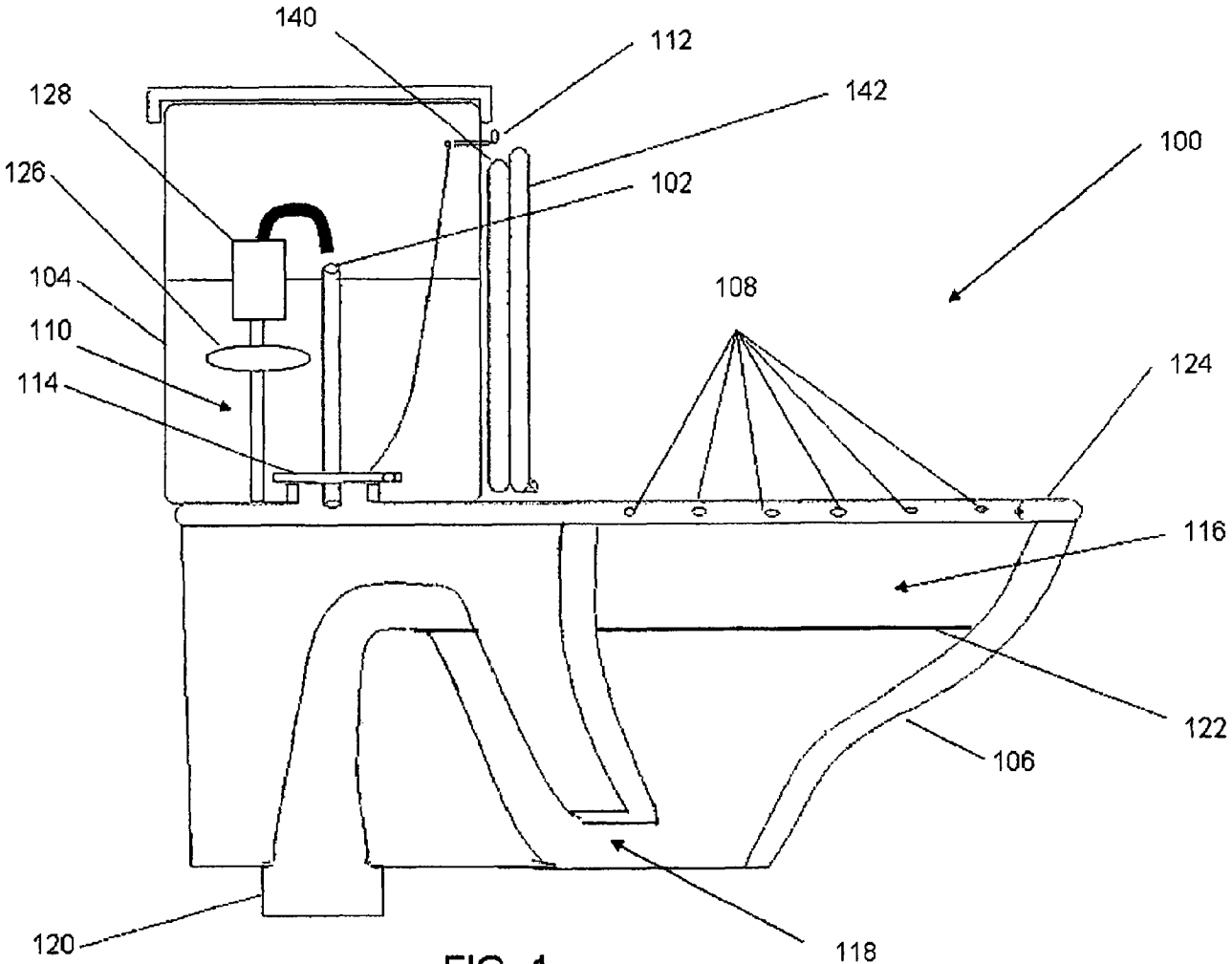
FIG. 1 Prior Art
FIG. 1 is a section view of a toilet with a seat and a lid hinged in an upward position.
Figure 2:
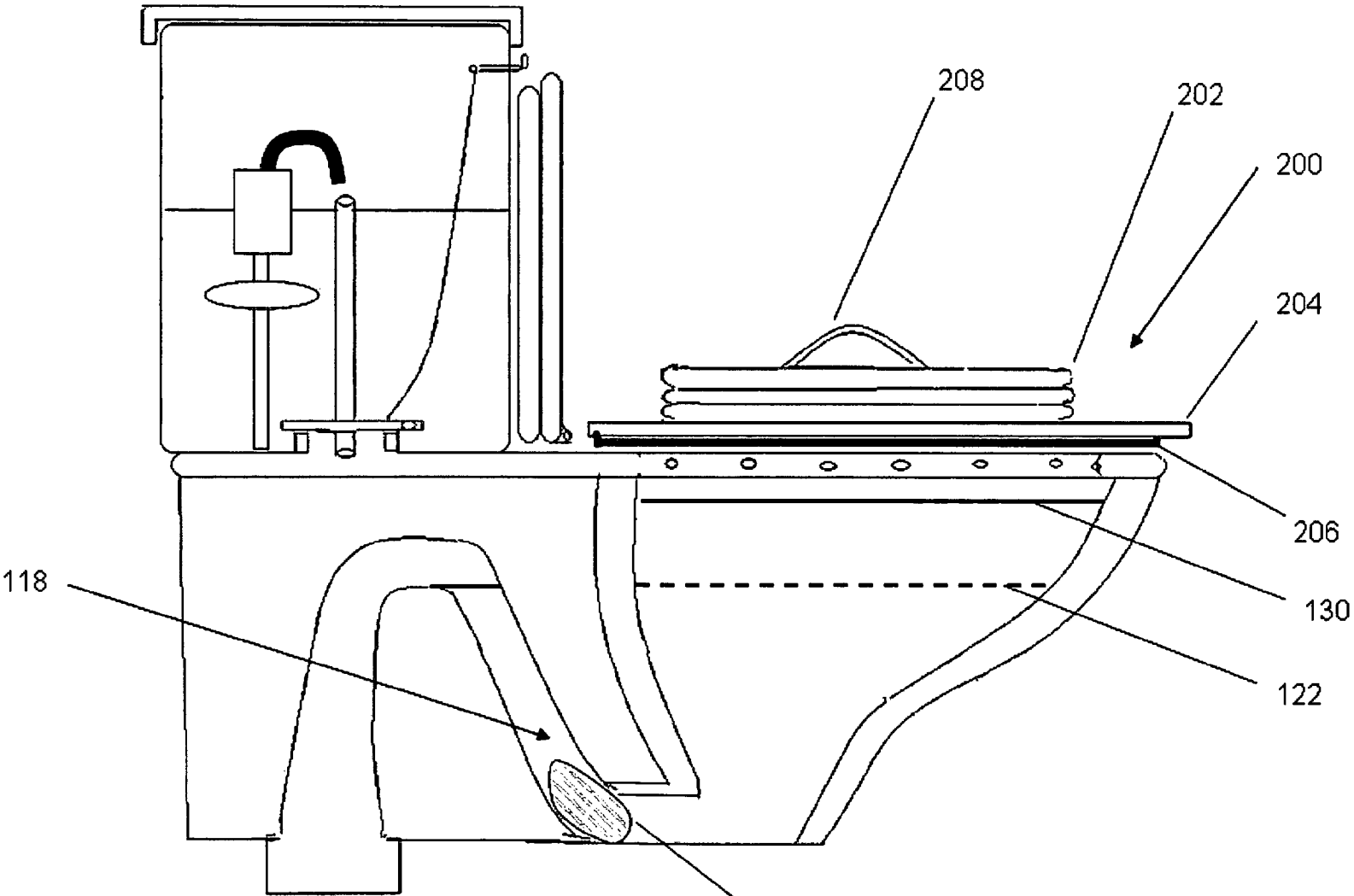
FIG. 2 is a section view of a clogged toilet and a first unclogging device in a first state consistent with a first embodiment of the invention.
Figure 3:
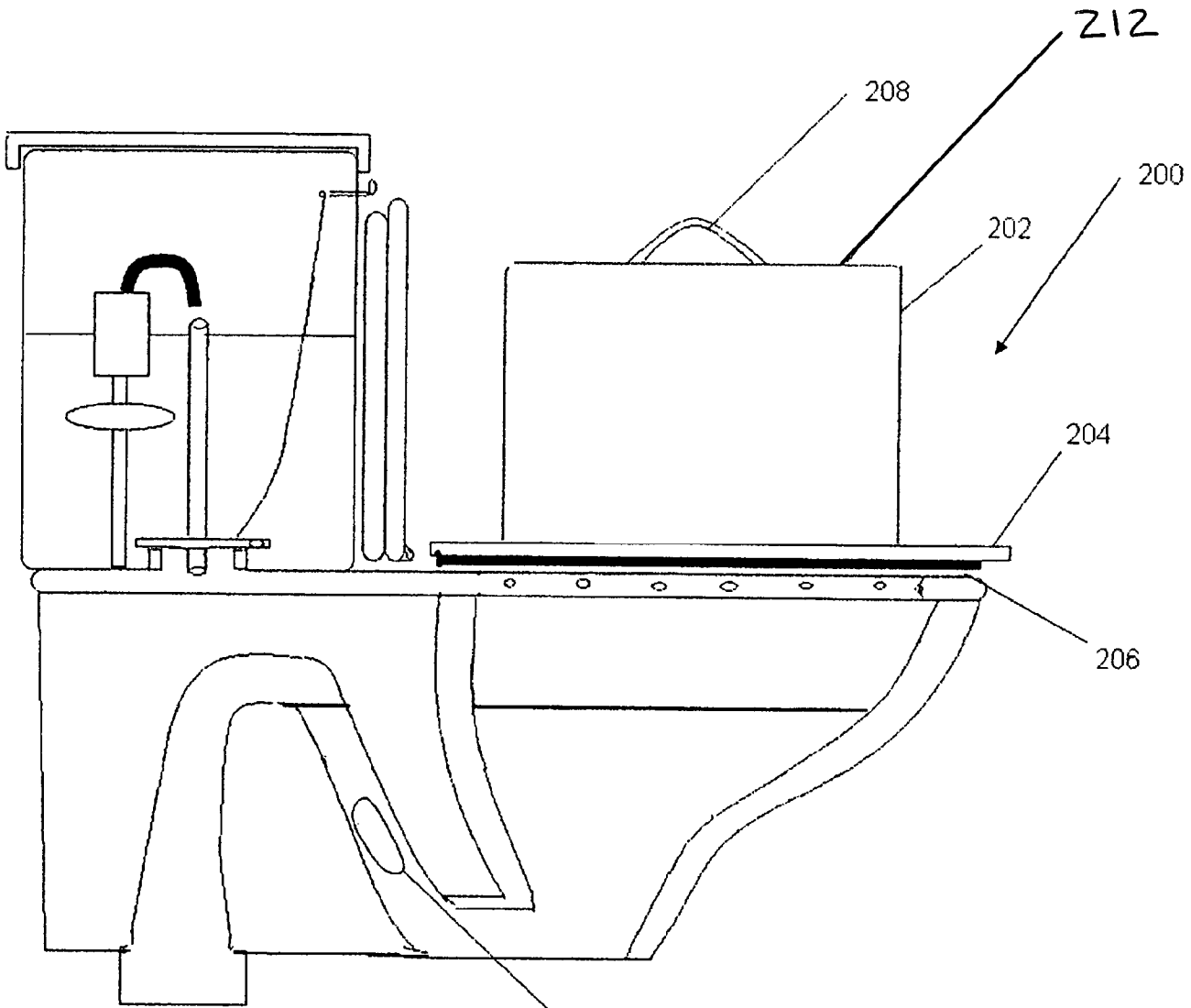
FIG. 3 is a section view of a toilet with the unclogging device of FIG. 2 in a second state and a reshaped or repositioned clog.
Figure 5:
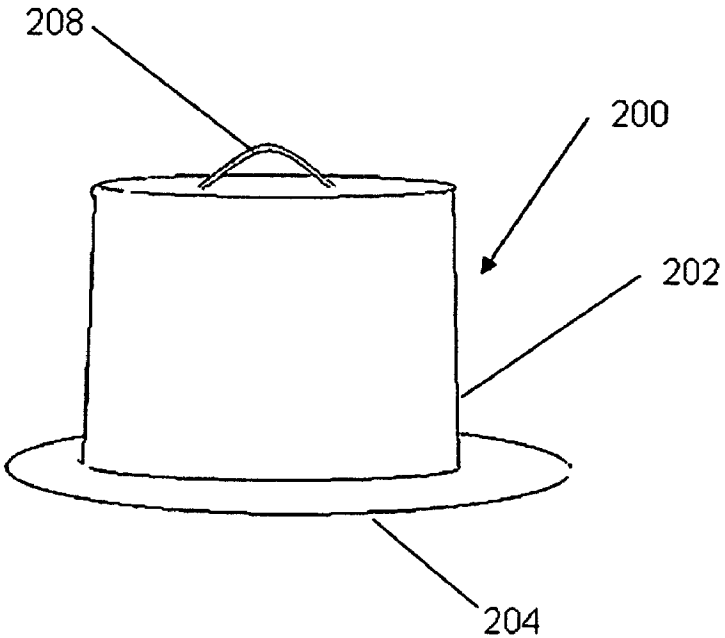
FIG. 5 is an isometric view of the unclogging device of FIG. 2 in the second state.
Figure 4:
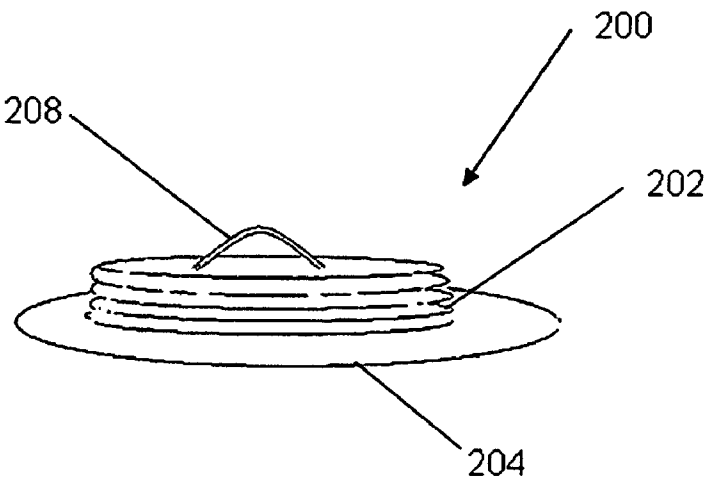
FIG. 4 is an isometric view of the unclogging device of FIG. 2 in the first state.

FIG. 2 is a section view of a clogged toilet 100 and an unclogging device 200 in a first state consistent with a first embodiment of the invention and FIG. 3 is a section view of the toilet 100 with the unclogging device 200 of FIG. 2 in a second state. An obstruction 220 may be located in the siphon 118 which may cause the water level in the inner toilet bowl area 116 to rise to an elevated level 130, above the normal level 122. The unclogging device 200 may have a diaphragm 202 movable between the first state and the second state. In the first state, a central portion of the diaphragm 202 is closer to the water line 130 in the inner toilet bowl area 116 and in the second state the central portion of the diaphragm 202 is further away from the water line 130. The diaphragm 202 may be a bellows and in the first state as shown in FIG. 2 (compressed state) the bellows has a smaller internal volume than in the second state as shown in FIG. 3 (extended state). The diaphragm shape may be circular, oval, rectangular, polygonal or other when viewed from above. A rectangular bellows having dimensions 5"×8" and being 12" tall in the expanded state has been shown to work well.

The diaphragm 202 may be coupled to a planar upper member 212 and a base portion 204 that has a bottom surface 206. The bottom surface 206 may be configured to contact the toilet bowl rim 124. The base portion 204 may be sized such that the bottom surface 206 contacts a variety of differently sized and shaped toilet bowl rims. A handle portion 208 may be coupled to the diaphragm 202 for pulling the diaphragm 202 from the first state to the second state. Although the handle portion 208 is shown as a having an enclosed space, for example a loop sized to allow fingers to be extended therethrough and secured at both end thereof to the planar upper member, for a hand to grasp, a handle could be considered any feature that can be grasped, seized, held, or taken advantage of in pulling the diaphragm to the second state. The handle does not have to be pulled vertically. Any diaphragm having a handle that can be pulled to create a temporary vacuum would work. The diaphragm 202 and the base portion 204 may be integrally formed at the same time of the same material or may be formed separately and then coupled together. The diaphragm 202 may be made of any flexible material, including but not limited to rubber, plastic, fabric, reinforced plastic fabric, and reinforced PVC fabric, for example 0.040" thick Durolast roofing material. In the first state, as shown in FIG. 2, the planar upper member 212 is generally parallel with and in close proximity to the top surface of the toilet bowl rim 124 and in the second state, as shown in FIG. 3, the planar upper member is generally parallel with, but spaced further from, the toilet bowl rim 124. As shown in FIG. 3, an upper portion of the diaphragm 202 may be coupled to the planar upper member 212 along a periphery of the upper planar member and a lower portion of the diaphragm 202 may be coupled to the base portion 204.

To reposition or reshape the obstruction 220 and thereby unclog the toilet, the user places the base portion 204 with the bottom surface 206 of the unclogging device 200 into contact with the toilet bowl rim 124 forming a seal, maintains the bottom surface 206 in contact with the toilet bowl rim 124, and then pulls quickly upward on the handle portion 208. Obstructions are often repositioned and/or reshaped enough to cause the water level to return to a more normal level with a single pull. The user may maintain the bottom surface 206 of the base portion 204 in contact with toilet bowl rim with the user's non-handle pulling hand, and/or an opposite side foot or knee, or with the toilet seat 142. A single pull of the handle portion 208 upward may create a temporary vacuum in the area above the water line in the inner toilet bowl area 116 which in turn may pull the whole obstruction 220 towards the water line in the toilet bowl or simply reposition or reshape the obstruction 220 enough that water in the inner toilet bowl area 116 can pass the obstruction 220. Since proper actuation of the unclogging device from the first state to the second state causes the pressure in the area above the water line in the inner toilet bowl area 116 to decrease as opposed to increase, the flush valve will not be forced open (which would cause more water to enter the toilet bowl area). The distance the user moves the handle 208 and the rate at which the handle 208 is moved may affect the amount of temporary vacuum formed. Typically the pull is completed in less than two seconds. After the vacuum has moved the obstruction closer to the water line in the toilet bowl, the obstruction may be repositioned or reshaped and the passing water may then naturally move the obstruction 220 with it and travel down the sewer line 120. If the obstruction 220 does not pass and the water level is low and safe, the user may then actuate the flush handle 112 on the toilet to add water above the obstruction 220, which may naturally move the obstruction 220 towards the sewer line 120.

If the clog is still not repositioned or sufficiently reshaped, the user can separate the unclogging device 200 from the toilet bowl rim 124 enough to break the seal with the toilet bowl rim 124 in order to reset the bellows to the start position, and try again. The unclogging device 200 ideally never comes in contact with the water and waste in the inner toilet bowl area 116 and thus is more sanitary and efficient. The bellows can be returned to the compressed state for storage under a sink or in a closet.

When the bottom surface 206 of the unclogging device 200 is placed in contact with the toilet bowl rim 124 and the diaphragm 202 is pulled upward, air may leak into the inner toilet bowl area 116 through the overflow tube which is fluidly open to the jets 108, without adversely affecting the vacuum created and the successful operation; even without blocking air from entering the overflow tube 102 in the inner tank area 110.

Figure 6:
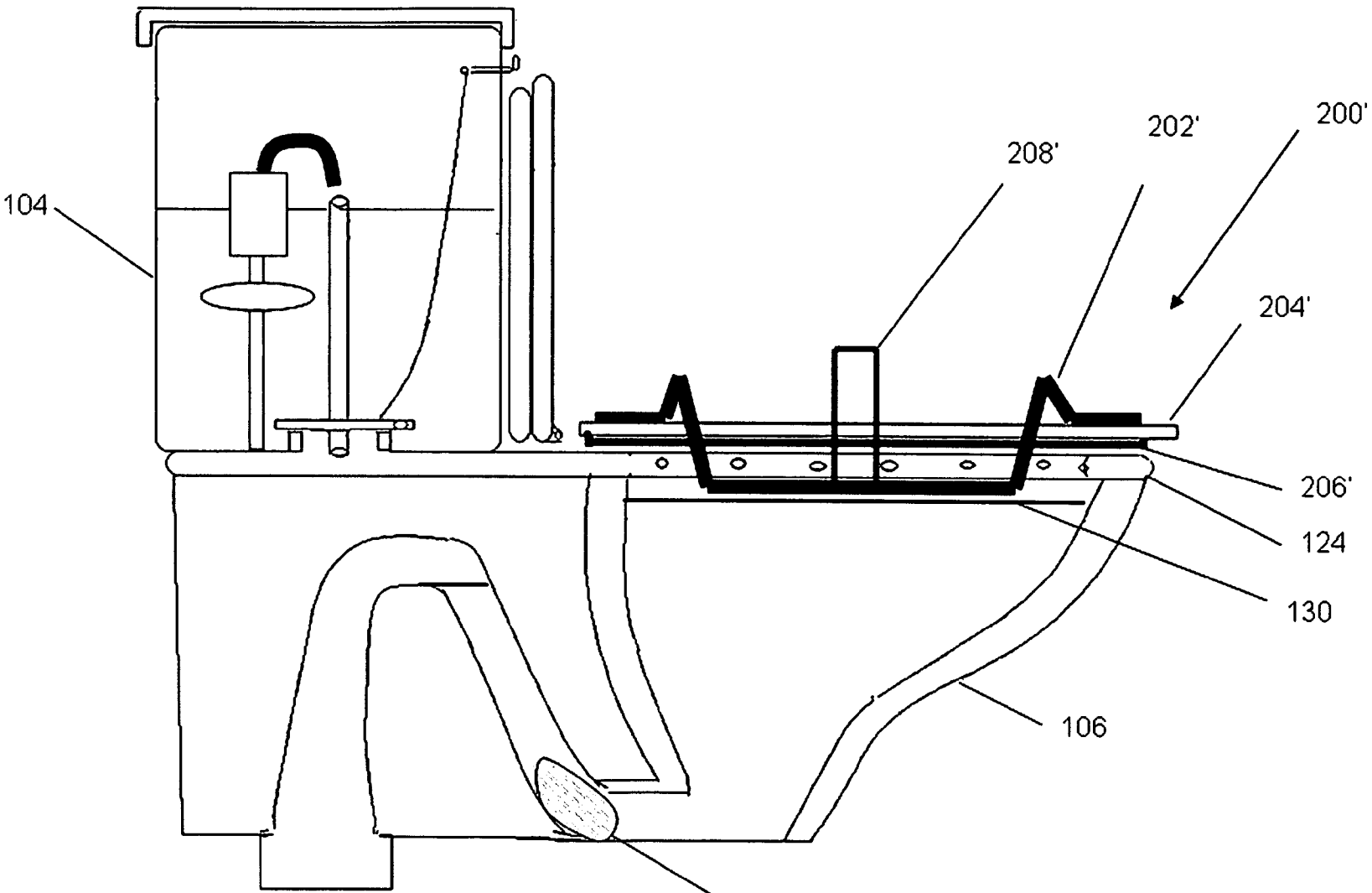
FIG. 6 is a section view of a clogged toilet and a second unclogging device in a first state consistent with a second embodiment of the invention.
Figure 7:
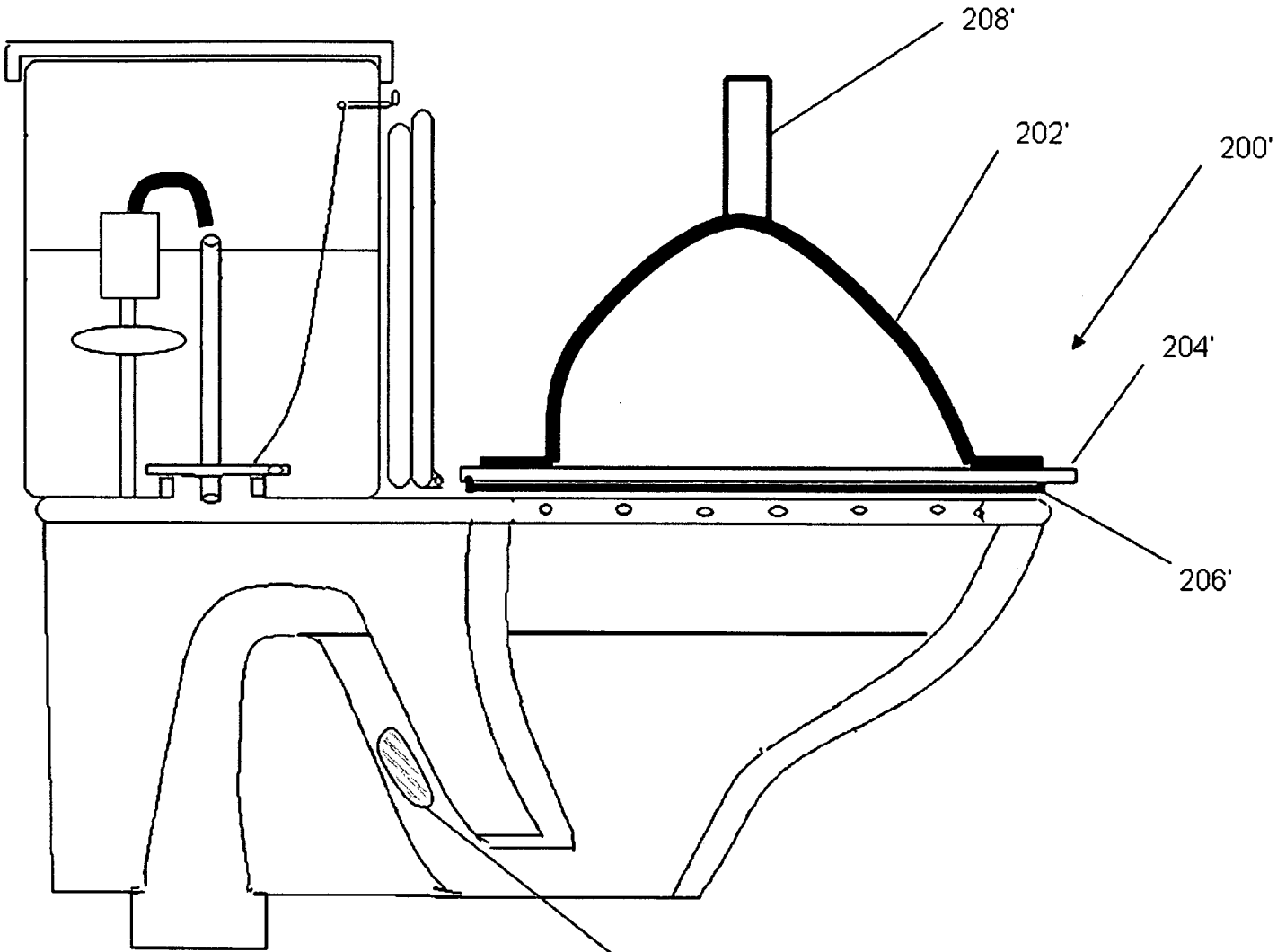
FIG. 7 is a section view of a toilet with the unclogging device of FIG. 6 in a second state and a reshaped or repositioned clog.

FIG. 6 is a section view of a clogged toilet 100 and a second embodiment unclogging device 200' in a first state consistent with a second embodiment of the invention and FIG. 7 is a section view of the toilet 100 with the second embodiment unclogging device 200' of FIG. 6 in a second state. As shown, the diaphragm 202' may have a hemispherical shape. In the first state, a central portion of the diaphragm 202' may extend below the toilet bowl rim 124 and in the second state the central portion of the diaphragm may extend above the toilet bowl rim 124. To reposition or reshape the obstruction 220 and thereby unclog the toilet, the user places a base portion 204' with a bottom surface 206' of the unclogging device 200' into contact with the toilet bowl rim 124, maintains the bottom surface 206' in contact with the toilet bowl rim 124, and then pulls quickly upward on a handle portion 208'.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

What is claimed is:

1. An apparatus for unclogging a toilet having an obstruction located below a water line in a toilet bowl, comprising:

a diaphragm movable between a first state and a second state;

a base portion coupled to a lower portion of the diaphragm, the base portion having a bottom surface configured to contact a toilet bowl rim;

a planar upper member coupled to an upper portion of the diaphragm; and a handle portion coupled to the planar upper member for pulling the diaphragm from first state to the second state and creating a temporary vacuum which pulls the obstruction towards the water line in the toilet bowl.

2. The apparatus of claim 1, wherein the handle portion is sized to allow fingers to be extended therethrough.

3. The apparatus of claim 1, wherein the diaphragm comprises one of a rubber, a reinforced fabric, and a reinforced PVC material.

4. The apparatus of claim 1, wherein the handle portion is a loop secured at each end thereof to the planar upper member.

5. The apparatus of claim 1, wherein the diaphragm is a bellows.

6. The apparatus of claim 5, wherein in the first state the bellows is compressed and in the second state the bellows is expanded.

7. The apparatus of claim 1, wherein in the first state the planar upper member is generally parallel with and in close proximity to the top surface of the toilet bowl rim and in the second state, the planar upper member is generally parallel with, but spaced further from, the toilet bowl rim.

8. The apparatus of claim 1, wherein the diaphragm has no valves.

9. The apparatus of claim 1, wherein the diaphragm is coupled to the planar upper member along a periphery of the planar upper member.

* * * * *